US005960601A

United States Patent [19]

Offutt

[11] Patent Number: 5,960,601

[45] Date of Patent: Oct. 5, 1999

[54] POST SUPPORT FRAME AND METHOD FOR MAKING SAME

[75] Inventor: Craig R. Offutt, Wildwood, Mo.

[73] Assignee: C & C Concerns, Inc., Wildwood, Mich.

[21] Appl. No.: 08/942,504

[22] Filed: Oct. 2, 1997

[51] Int. Cl.[6] ..... E04C 5/12

[52] U.S. Cl. ..... 52/292; 52/169.13; 52/698; 52/713; 52/745.19; 256/1; 256/DIG. 5; 403/340; 403/375; 403/400; 29/897.3; 29/897.312; 29/897.33

[58] Field of Search ..... 52/292, 698, 713, 52/736.1, 736.2, 651.01, 653.1, 745.19, 169.13, 170; 248/174; 256/1, 65, DIG. 5; 403/340, 375, 400; 29/897.3, 897.312, 897.33

[56] References Cited

U.S. PATENT DOCUMENTS

| | | | |
|---|---|---|---|
| 826,996 | 7/1906 | Cooke | 52/736.2 X |
| 1,529,895 | 3/1925 | Chance et al. | 52/292 |
| 2,235,290 | 3/1941 | Exline et al. | 248/174 X |
| 3,728,837 | 4/1973 | Kiefer, Jr. . | |
| 4,809,955 | 3/1989 | Veilleux . | |
| 5,129,628 | 7/1992 | Vesper . | |
| 5,303,900 | 4/1994 | Zulick, III et al. . | |
| 5,359,827 | 11/1994 | Gehman . | |

*Primary Examiner*—Robert Canfield
*Attorney, Agent, or Firm*—Woodard, Emhardt, Naughton Moriarty & McNett

[57] ABSTRACT

A post support frame is provided comprising brackets, a top plate, and a bottom plate. In one embodiment, the brackets are identical and generally H-shaped. The crossbar of the H includes a slot substantially perpendicular to the crossbar, and the ends of the legs of the H each have a tab. Each leg also includes a part which tapers inward toward the adjacent leg. The top plate includes a series of notches around its periphery, which accommodate the tabs at the ends of the bracket legs. The bottom plate includes two sets of holes therethrough. One set of holes accommodates the tabs at the ends of the bracket legs, while the other is used for attaching the completed post support frame to a flat surface.

The support frame is assembled by interengaging the slots of the brackets. The interengaged brackets are coupled with the bottom and top plates by fitting the tabs at the ends of the brackets into one set of the holes in the bottom plate and the notches in the top plate. Tack welding may be used at discrete points, for example between the crossbar portions of the brackets or between the tabs of the brackets and the plates, to further fix the brackets and plates to each other.

16 Claims, 5 Drawing Sheets

POST SUPPORT FRAME AND METHOD FOR MAKING SAME

BACKGROUND OF THE INVENTION

This invention relates generally to a support structure for elongated hollow posts. More specifically, the invention relates to a post support frame comprising a plurality of brackets and plates which are interconnected without external fasteners and with little or no welding or other such affixation. Over the assembled support, a hollow post, such as a fence post, may be fitted. Additionally, this invention further relates to a method of making the post support frame of the invention.

It has been known to use hollow posts, particularly posts made of plastic, as an alternative to construction of wood, metal, or other materials. Hollow plastic posts are generally more durable than metal or wood posts, being impervious to rot or corrosion. They are also generally more economical than expensive and labor-intensive metal or wood posts. Not only are metal or wood posts expensive to purchase, but they require care, for example painting and/or chemical treatment, to keep them in good order.

In use, posts in general, and hollow plastic posts in particular, are fixed or mounted along a generally flat surface, such as a deck, floor, stair, or other surface. Mounting hollow plastic posts can be accomplished in a number of ways. First, the post may be attached directly to the flat surface, commonly at or near the base of the post. This method has the disadvantage of placing extreme stresses on a very small area at or near the base of the post. When a force acts on a directly mounted post, a torque is generated about an axis through the base of the post. Such torques tend to damage the base and/or the flat surface to which the post is attached.

The post may also be fitted into a socket provided in the flat surface. For example, cement stairs may be poured or a wooden deck may be constructed so as to leave holes or sockets therein of the same shape and size as the posts to be used. The posts are then mounted by fitting the post into the socket, and in some cases tightening or fixing them therein using screws, bolts, or similar items. There are several disadvantages to this system. Providing holes or sockets of the proper size in a flat surface requires considerable planning, time, and effort over and above the construction of the surface itself. Errors in the sizing and/or placement of the sockets within the surface are not easily remedied. Further, this method also suffers the same set of drawbacks noted above for posts attached at or near the bottom of the post.

A preferred installation scheme is to provide an inner support frame for hollow posts. Currently known post support frames are made of a multitude of pieces welded together by hand. For example, a plurality of elongated members may be welded at their respective ends to a base plate. Bracing elements may also be welded between pairs of elongated members to increase the rigidity of the support frame. In addition, a top plate may be welded or secured by a central screw to the ends of the elongated members opposite the base plate. After fitting a hollow post on such a support frame, it is also known to anchor the post to the frame using screws or other attachment elements which may pierce the post at one or more locations.

However, such currently-known support frames have several disadvantages. First, their manufacture is relatively expensive and takes a relatively long time. Such support frames are currently manufactured using hand made, non-tooled metal rod construction. Numerous parts must be ordered or manufactured and then assembled piece by piece by hand-welding each part to its adjoining parts, or by attaching adjoining parts with screws or other attachment elements.

Second, the substantial welding required for assembly causes deterioration of the metal in the support frame. Commonly, stainless steel is used in currently known support frames in order to prevent corrosion. However, welding often adversely affects the corrosion resistance of stainless steel. Since welding is generally necessary between abutting parts of known support frames so as to insure their rigidity, a substantial portion of known support frames is susceptible to corrosion.

Further, as noted above, hollow posts may be anchored to support frames by attachment elements through holes in the post. These orifices can allow air, water, and associated chemicals to contact the welded posts, exacerbating the risk of corrosion and damage.

Accordingly, there is a need for a support frame for hollow plastic posts which overcome the above-described problems. Specifically, there is a need for a post support frame which is easier and more economical to manufacture. The support frame should require minimal welding. Further, the support frame should accommodate a hollow plastic fence post and retain it without orifices in the post or otherwise compromising the integrity of the post.

SUMMARY OF THE INVENTION

One feature of the present invention is a fence post support frame which does not suffer the drawbacks of currently known support frames. This support frame comprises two brackets, a top plate, and a bottom plate. In the preferred embodiment, the brackets are identical and generally in the shape of the letter H. The crossbar portion of the H includes a slot substantially perpendicular to the crossbar, and the four ends of the leg portions of the H each have a small projection or tab. Each leg portion of the brackets also includes a part which tapers inward toward the adjacent leg portion. The top plate includes a series of notches around its periphery, which accommodate the tabs at the ends of the leg portions of the brackets. The bottom plate includes two sets of holes therethrough. One set of holes accommodates the tabs at the ends of the leg portions of the brackets, while the other is used for attaching the completed fence post support frame to a flat surface.

In another aspect of the present invention, the support frame is assembled by interengaging the slots of the two brackets, so that the crossbar portion of one bracket fits into the slot of the other bracket, and vice versa. Preferably, when the brackets are interengaged the end walls of the slots abut each other. The interengaged brackets are coupled with the bottom and top plates by fitting the tabs at the ends of the brackets into one set of the holes in the bottom plate and the notches in the top plate. Tack welding may be used at discrete points, for example between the crossbar portions of the brackets or between the brackets and the plates, to further fix the brackets and plates to each other.

In another aspect of the present invention, the support frame parts are manufactured using a metal stamping process. The brackets are made by a one-piece metal stamping process in which a single mold and stamp are used to manufacture brackets of different sizes and thicknesses from a metal web. In this way, the support frame of the present invention may be more easily and economically manufactured than known support frames. Further, the support frame of the present invention may carry a corrosion-resistant coating, such as an iron phosphate coating applied by dipping the completed frame.

DESCRIPTION OF THE PREFERRED EMBODIMENT

Figure 1:
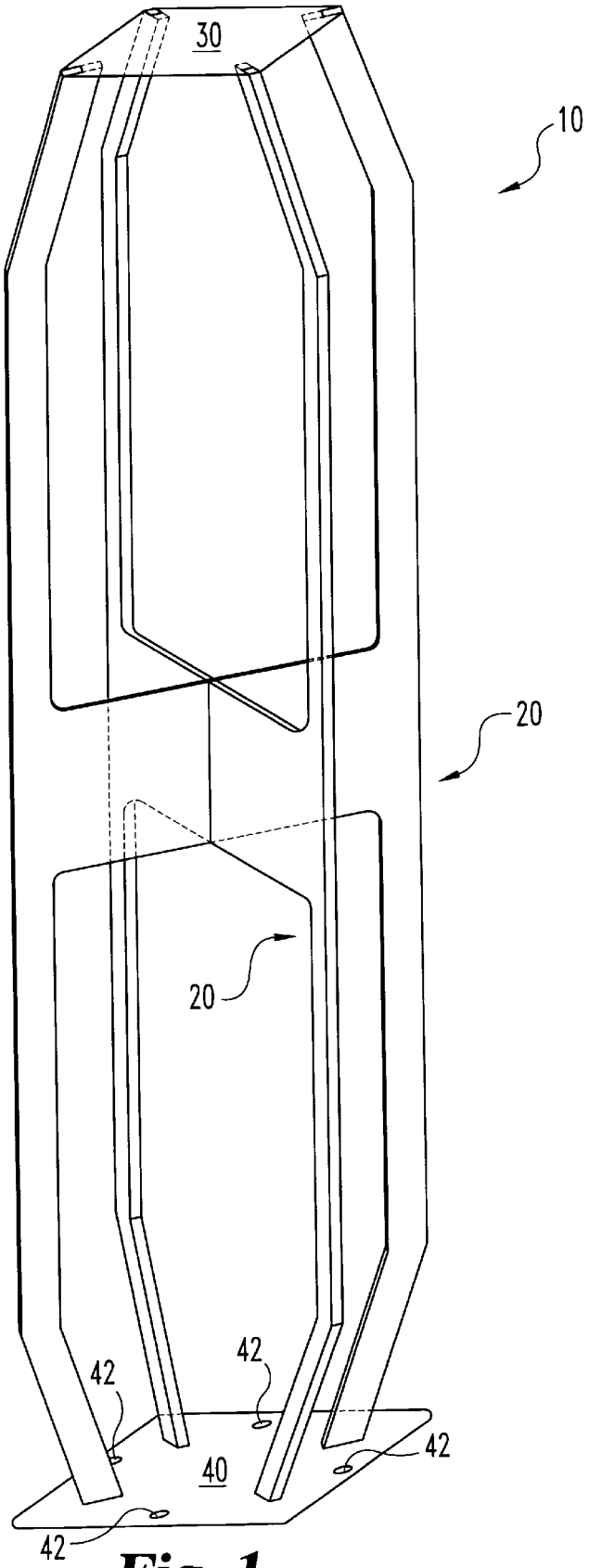
FIG. 1 is a perspective view of the preferred embodiment of the post support frame of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, any alterations and further modification in the described or illustrated device and method, and any further applications of the principles of the invention as illustrated therein being contemplated as would normally occur to one skilled in the art to which the invention relates.

Referring generally to FIG. 1, there is shown the preferred embodiment of the post support frame 10 of the present invention. Support frame 10 includes brackets 20, a top plate 30, and a bottom plate 40. In a specific embodiment, brackets 20 are identical with each other. Preferably, brackets 20, top plate 30, and bottom plate 40 are made from a metal or metallic alloy such as the steel alloy known as CRS C1010 also known in the trade as "Hot Roll"; however, other materials as would occur to those skilled in the art are also contemplated. As described further hereinafter, brackets 20 are slidingly interengaged with each other, and top plate 30 and bottom plate 40 are coupled to the ends of interengaged brackets 20.

Figure 2:
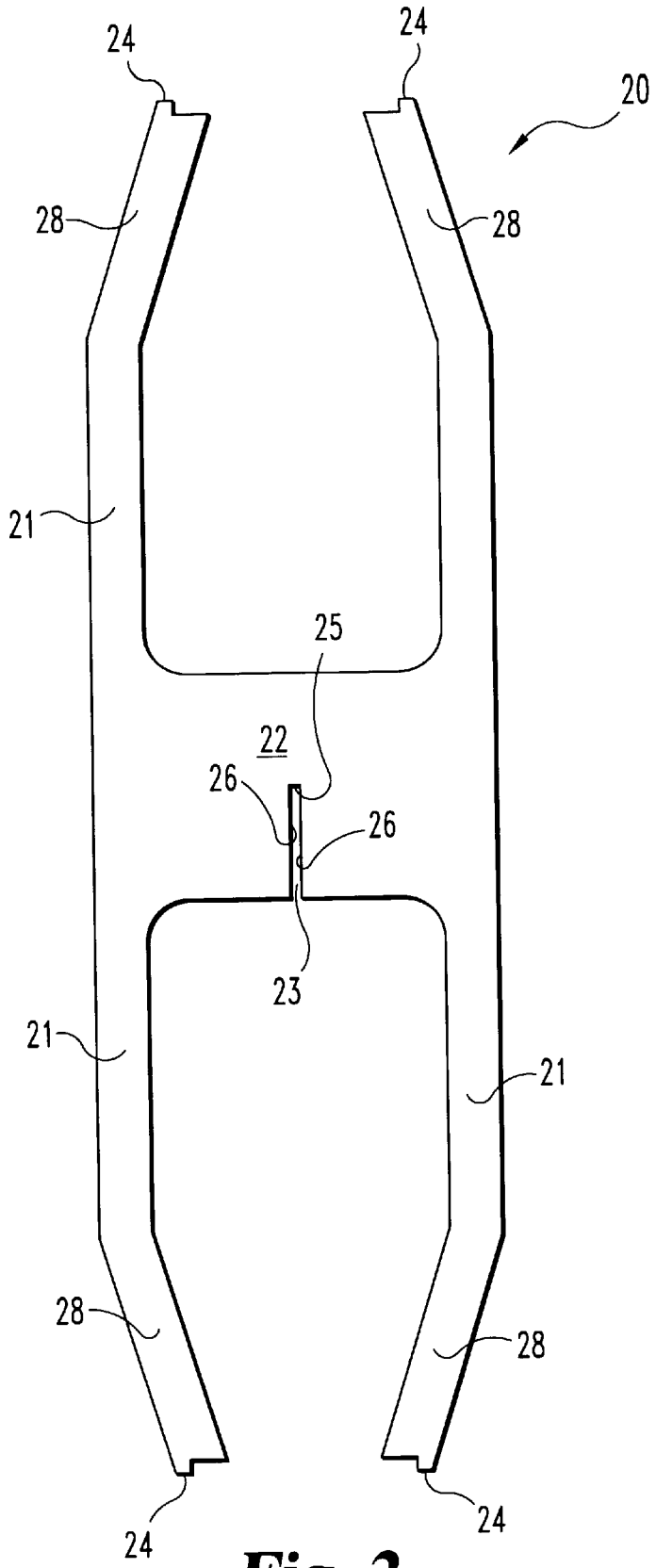
FIG. 2 is an elevational view of a bracket of the embodiment of the present invention as depicted in FIG. 1.

Referring now generally to FIG. 2, bracket 20 is shown in one embodiment. Bracket 20 is generally planar and in the shape of the letter H, having four leg portions 21 and a crossbar portion 22. Crossbar portion 22 includes a slot 23 defined by end wall 25 and side walls 26. Each leg portion 21 has a tab 24, which may be generally square, extending therefrom. In one specific embodiment, slot 23 is generally perpendicular to crossbar portion 22 and generally parallel to leg portions 21, leg portions 21 each have a distal portion 28 which is tapered inward, i.e. toward the adjacent leg portion 21, and tabs 24 are generally square in shape.

Figure 3:
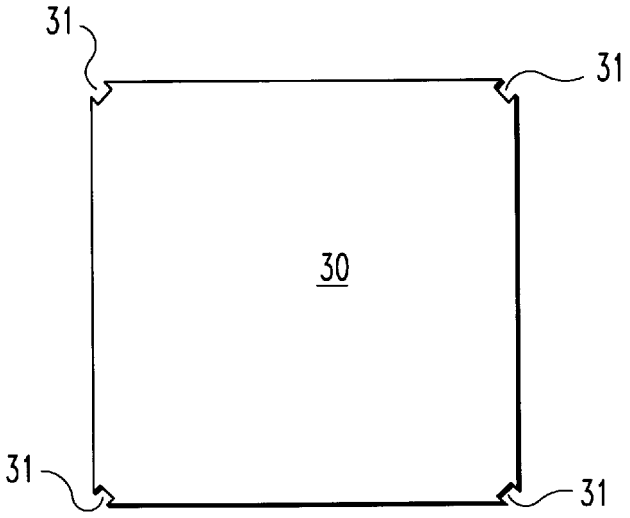
FIG. 3 is a top plan view of the top plate of the embodiment of the present invention as depicted in FIG. 1.

Referring now generally to FIG. 3, top plate 30 is shown in one embodiment. Top plate 30 is generally planar. Around the peripheral edge of top plate 30 are a series of notches 31 which are configured to engage with tabs 24 of brackets 20. In a specific embodiment, top plate 30 is square, having one square notch 31, of approximately the same size as tabs 24 of brackets 20, in each corner thereof.

Figure 4:
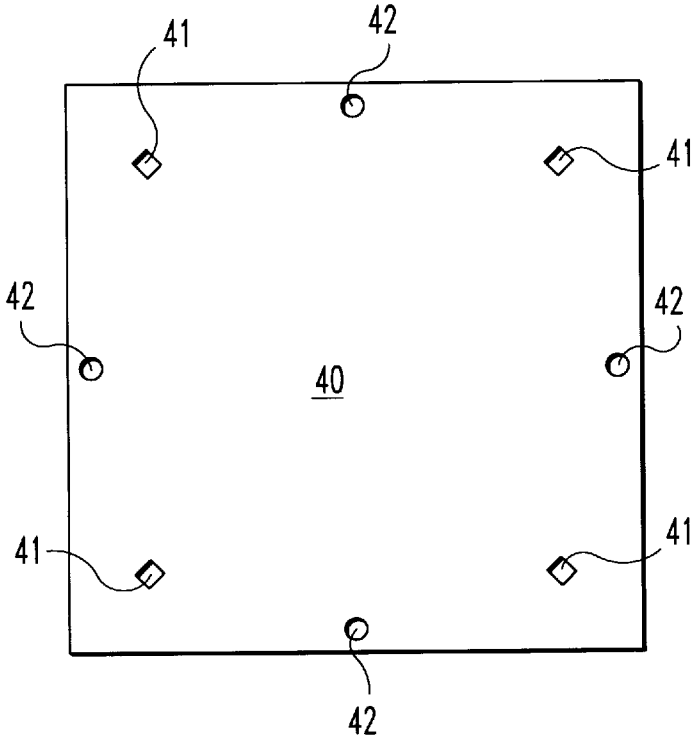
FIG. 4 is a top plan view of the bottom plate of the embodiment of the present invention as depicted in FIG. 1.

Now referring generally to FIG. 4, there is shown one embodiment of bottom plate 40 of the present invention. Bottom plate 40 is generally planar. Bottom plate 40 includes a first set of holes 41 therethrough. Holes 41 are configured to engage with tabs 24 of brackets 20. Additionally, bottom plate 40 includes a second set of holes 42 for attaching the completed support frame 10 to a flat surface 50 (depicted generally in FIG. 6) using screws or other appropriate fastening elements 51 (depicted generally in FIG. 6). In one specific embodiment, bottom plate 40 is square and has one square tab-engaging hole 41, of approximately the same size as tabs 24 of brackets 20, located near each corner of bottom plate 40, and has a round fastening-hole 42 located at the midpoint of each side of bottom plate 40.

Figure 5:
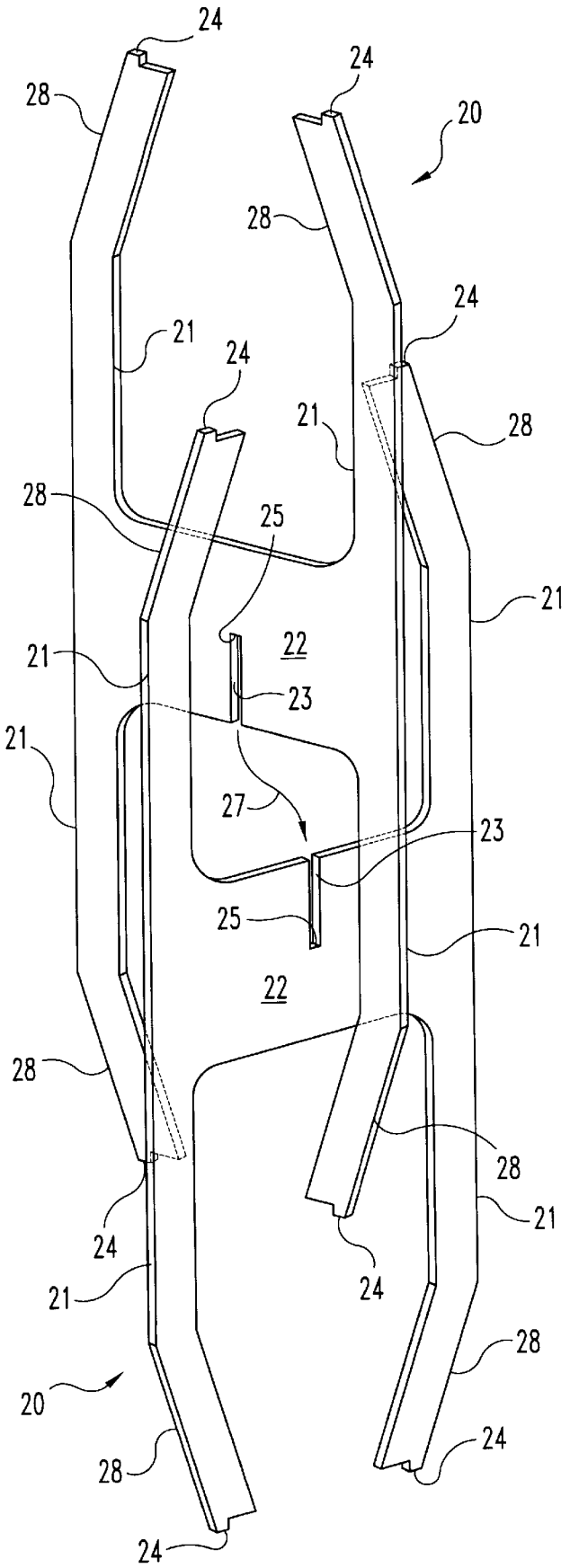
FIG. 5 is a perspective view of two brackets of the present invention as depicted in FIG. 2, showing the preferred method of interengaging the brackets form the embodiment of the present invention depicted in FIG. 1.

Referring generally now to FIG. 5, assembling support frame 10, in one aspect of the present invention, is accomplished as follows. Brackets 20 are interconnected by engaging their respective slots 23 and sliding brackets 20 together in the direction of arrow 27, so that at least a portion of crossbar portion 22 of each bracket 20 fits within slot 23 of other bracket(s) 20. In one specific embodiment, end walls 25 of slots 23 of each bracket 20 abut each other. Top plate 30 and bottom plate 40 are coupled to opposing ends of interconnected brackets 20 by fitting tabs 24 of brackets 20 into notches 31 of top plate 30 and tab-engaging holes 41 of bottom plate 40.

In the embodiment in which bracket 20, top plate 30 and bottom plate 40 are made of a metal or metallic alloy, assembled support frame 10 may be further secured by placing tack welds on brackets 20 at one or more points where the crossbar portions 22 of the brackets 20 abut. Tack welds may also be placed at one or more points where brackets 20 abut top plate 30 and/or bottom plate 40. After assembly, support frame 10 may also be treated with a corrosion-preventing agent. In one specific embodiment, support frame 10 is dipped in iron phosphate to provide a homogeneous corrosion-resistant coating.

Figure 6:
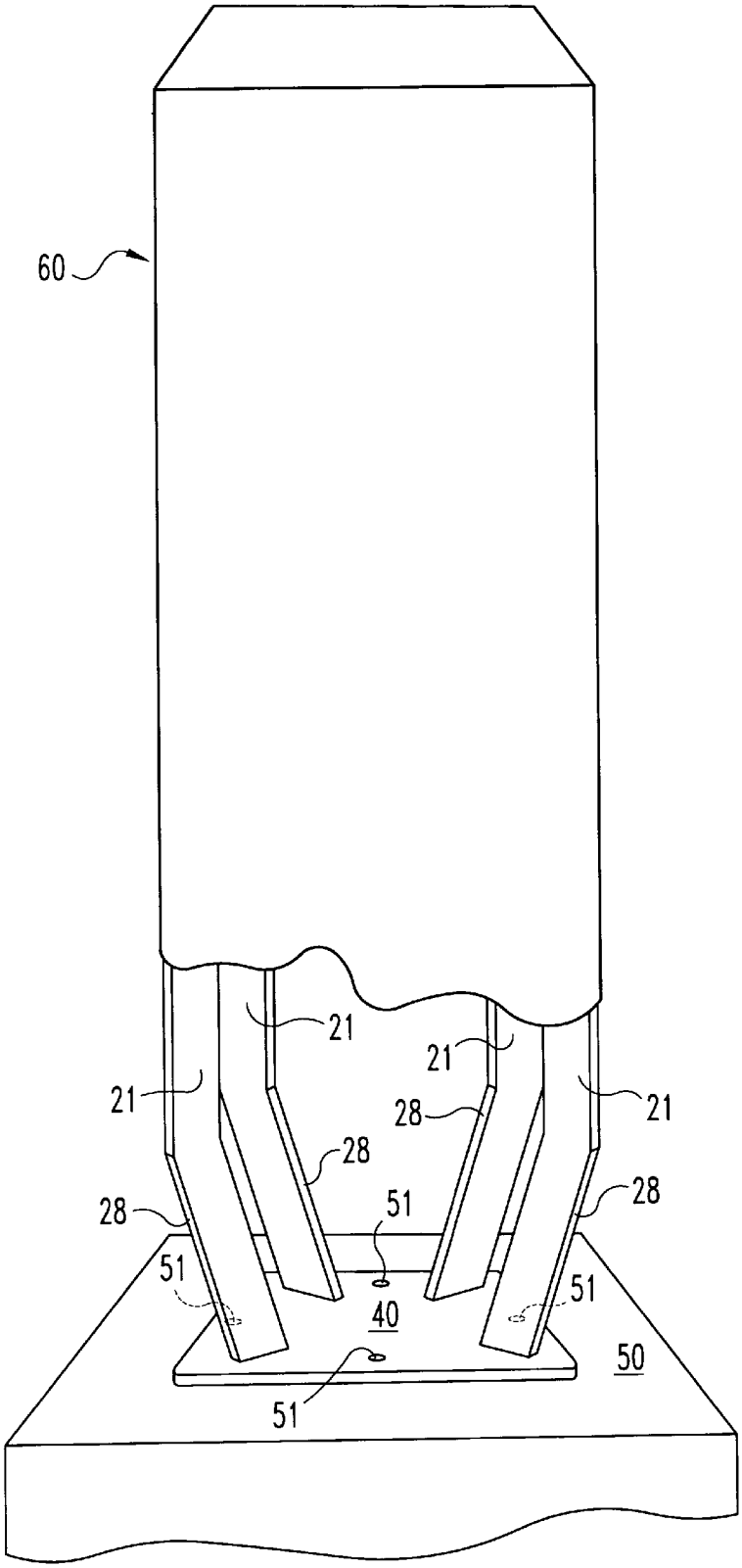
FIG. 6 is a perspective view of a hollow post mounted on the post support frame of the present invention, with the bottom of the post cut away to show the mounting of the post support frame on a flat surface.

Referring now generally to FIG. 6, in one embodiment of the use of the present invention, the fully assembled frame 10 is mounted to a generally flat surface 50, such as a deck, stair, or the like. In a specific embodiment, fixation elements such as screws 51 may be driven into flat surface 50 through fastening-holes 42, thereby holding bottom plate 40 and the remainder of frame 10 fast to the surface. A hollow post 60, such as a fence post, is mounted onto frame 10 by sliding post 60 down over top plate 30, interengaged brackets 20, and bottom plate 40. In one specific embodiment, post 60 is slid down over frame 10 until the post abuts flat surface 50 to which frame 10 is mounted.

Brackets 20, top plate 30 and bottom plate 40 are preferably manufactured from a metal or metallic alloy by a stamping process. To manufacture brackets 20, a metal web is stamped with a mold. The stamped piece is then turned 180 degrees around an axis perpendicular to the web and stamped again. By simple adjustments to the mold, brackets of varying dimension are able to be produced.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A frame for supporting a hollow post, comprising:

a plurality of brackets, said brackets each having a plurality of elongated leg portions and a crossbar portion, said crossbar portion having a slot therein, said plurality of brackets being interengaged whereby said slot of each of said plurality of brackets accommodates a portion of said crossbar portion of at least one of said plurality of brackets;

a first plate engaging a first portion of said leg portions of said interengaged brackets; and a second plate engaging a second portion of said leg portions of said interengaged brackets.

2. The frame of claim 1 wherein said brackets, said first plate and said second plate are made of metal.

3. The frame of claim 1, wherein said brackets are generally identically shaped.

4. The frame of claim 3, wherein said brackets are generally H-shaped.

5. The frame of claim 4, wherein said leg portions of said brackets have an inwardly tapering portion configured to engage at least one of said first and second plates.

6. The frame of claim 4, wherein said brackets are interengaged generally orthogonally.

7. The frame of claim 1, wherein said slot is generally perpendicular to said crossbar portion.

8. The frame of claim 1, wherein said leg portions each have a tab extending therefrom, and said first plate and said second plate each have a plurality of openings for engaging a portion of said tabs of said leg portions.

9. The frame of claim 8, wherein said first plate has a peripheral edge and said plurality of openings of said first plate are arranged on said edge.

10. The frame of claim 8, wherein said second plate has a second plurality of openings for attaching said plate to a flat surface.

11. A method of manufacturing a frame for supporting a hollow post, comprising the steps of:

interengaging a plurality of brackets, each of said brackets having a plurality of elongated legs and a crossbar with a slot defined therein and at least one tab projecting from each of the legs of said brackets, by engaging said slots;

engaging a top plate having notches therein to said brackets by inserting a portion of said tabs of said brackets into said notches;

engaging a bottom plate having at least one set of holes therein to said brackets by inserting a portion of said tabs into at least a portion of said holes.

12. The method of claim 11, further comprising the step of stamping a metal web to form said brackets.

13. The method of claim 11 further comprising the step of tack welding at least one point of intersection between said brackets.

14. The method of claim 11 further comprising the step of tack welding at least one point of intersection between at least one of said brackets and at least one of said top plate and said bottom plate.

15. The method of claim 11 further comprising the step of covering said frame with a corrosion-resistant coating.

16. The method of claim 15 wherein said covering step comprises dipping said frame in iron phosphate.

* * * * *

UNITED STATES PATENT AND TRADEMARK OFFICE

CERTIFICATE OF CORRECTION

PATENT NO. : 5,960,601

DATED : October 5, 1999

INVENTOR(S) : Craig R. Offutt

It is certified that error appears in the above-identified patent and that said Letters Patent is hereby corrected as shown below:

Title page, item [73], Assignee: delete "Mich." and insert --MO--.

Signed and Sealed this

Twelfth Day of September, 2000

*Attest:*

*Attesting Officer*

Q. TODD DICKINSON

*Director of Patents and Trademarks*